US010519005B2

(12) United States Patent
Rivero

(10) Patent No.: US 10,519,005 B2
(45) Date of Patent: Dec. 31, 2019

(54) FALL ARREST DEVICES, AND RELATED METHODS

(71) Applicant: AIP APS, Hillerød (DK)

(72) Inventor: José Javiér Nuñez Rivero, La Muela (ES)

(73) Assignee: AIP APS, Hillerod (DK)

( * ) Notice: Subject to any disclaimer, the term of this patent is extended or adjusted under 35 U.S.C. 154(b) by 0 days.

(21) Appl. No.: 16/323,049

(22) PCT Filed: Jul. 31, 2017

(86) PCT No.: PCT/EP2017/069363
§ 371 (c)(1),
(2) Date: Feb. 4, 2019

(87) PCT Pub. No.: WO2018/024694
PCT Pub. Date: Feb. 8, 2018

(65) Prior Publication Data

US 2019/0168998 A1 Jun. 6, 2019

(30) Foreign Application Priority Data

Aug. 3, 2016 (EP) ..... 16382383

(51) Int. Cl.
*B66B 5/18* (2006.01)
*B66B 5/00* (2006.01)
(Continued)

(52) U.S. Cl.
CPC ..... *B66B 5/185* (2013.01); *B66B 5/0087* (2013.01); *B66B 5/044* (2013.01); *B66B 5/048* (2013.01); *B66B 5/24* (2013.01)

(58) Field of Classification Search
CPC ..... B66B 5/185; B66B 5/0087; B66B 5/044; B66B 5/048; B66B 5/24
See application file for complete search history.

(56) References Cited

U.S. PATENT DOCUMENTS 4,029,177 A * 6/1977 Fiss ..... B66B 5/044 187/374
5,228,540 A * 7/1993 Glaser ..... B66B 5/04 187/355

(Continued)

FOREIGN PATENT DOCUMENTS

CN 204 802 811 U 11/2015

OTHER PUBLICATIONS

The International Search Report (ISR) for PCT/EP2017/069363 dated Oct. 9, 2017, pp. 1-3.

(Continued)

*Primary Examiner* — Michael A Riegelman
(74) *Attorney, Agent, or Firm* — McDonnell Boehnen Hulbert & Berghoff LLP

(57) ABSTRACT

A fall arrest device comprises a casing with an entry hole for the wire rope, and an exit hole for the wire rope, and a clamping mechanism and an overspeed detector arranged inside the casing. The speed detection mechanism comprises a driven roller arranged to be driven by the wire rope. The driven roller has one or more selected areas to be detected by a sensor, and the device further comprises a motion indicator configured to receive a signal from the sensor when the sensor detects one of the selected areas. The motion indicator is configured to give different indications depending on whether or not the signal is received from the sensor, and such indications are detectable from outside the casing. Methods for operating such a fall arrest device and method for retrofitting fall arrest devices are also disclosed.

20 Claims, 4 Drawing Sheets

(51) Int. Cl.
*B66B 5/24* (2006.01)
*B66B 5/04* (2006.01)

(56) References Cited

U.S. PATENT DOCUMENTS

| | | | | |
|---|---|---|---|---|
| 5,628,385 | A * | 5/1997 | Yumura | B66B 5/044 187/373 |
| 5,731,528 | A * | 3/1998 | Yamazaki | G01L 5/042 73/828 |
| 10,099,904 | B1 * | 10/2018 | Zaguroli, Jr. | B66D 1/54 |
| 2006/0090969 | A1 * | 5/2006 | Eckenstein | B66B 5/185 188/65.1 |
| 2007/0007083 | A1 * | 1/2007 | Husmann | B66B 5/20 187/366 |
| 2007/0227826 | A1 * | 10/2007 | Nakagawa | B66B 5/00 187/252 |
| 2012/0152658 | A1 * | 6/2012 | Osmanbasic | B66B 5/044 187/288 |
| 2015/0344267 | A1 * | 12/2015 | Valjus | B66B 5/0037 187/254 |
| 2018/0332368 | A1 * | 11/2018 | Copeland | H04L 67/12 |
| 2019/0168998 | A1 * | 6/2019 | Rivero | B66B 5/185 |

OTHER PUBLICATIONS

Written Opinion of the International Searching Authority for PCT/EP2017/069363 dated Oct. 9, 2017, pp. 1-6.

* cited by examiner

FALL ARREST DEVICES, AND RELATED METHODS

CROSS-REFERENCE TO RELATED APPLICATIONS

This application is a U.S. national phase of International Application No. PCT/EP2017/069363, filed Jul. 31, 2017, which claims priority from European Patent Application no. 16382383.4, filed Aug. 3, 2016, the disclosure of each of which is incorporated herein by reference in its entirety.

The present disclosure relates to fall arrest devices, and further relates to methods of operating or using fall arrest devices and methods for retrofitting fall arrest devices.

BACKGROUND

Modern wind turbines are commonly used to supply electricity into the electrical grid. Wind turbines generally comprise a rotor mounted on top of a wind turbine tower, the rotor having a rotor hub and a plurality of blades. The rotor is set into rotation under the influence of the wind on the blades. The operation of the generator produces the electricity to be supplied into the electrical grid.

When maintenance works are required inside wind turbines, hoists are often used in the form of elevator-like structures where a lift platform or a cabin for the transportation of people and/or equipment is hoisted up and/or down within the wind turbine tower. Wind turbines are often provided with working platforms arranged at various heights along the height of the tower with the purpose of allowing workers to leave the cabin and inspect or repair equipment where intended.

Elevator systems, in general, include an elevator car being suspended within a hoistway or elevator shaft by wire ropes. The term wire rope is herein used to denote a relatively thick cable. But in the art, the terms cables and wire ropes are often used interchangeably. In some systems, e.g. for some electric elevators, a counterweight may be provided depending on e.g. the available space. Other systems such as hydraulic elevators normally do not comprise a counterweight.

The service elevators may incorporate some form of traction device mounted on or attached to the elevator. The traction device may comprise a housing including a traction mechanism, e.g. a motor driven traction sheave. The motor typically may be an electrical motor, although in principle other motors could be used.

Service elevators further may incorporate an electromagnetic brake. In addition to this brake, a "secondary safety device" or "fall arrest device" may be mounted on or attached to the elevator. Such a fall arrest device serves as a back-up for the main electromagnetic brake and may typically incorporate some form of sensing mechanism sensing the elevator's speed. The secondary safety device may automatically block the elevator and inhibit any further movement if the elevator moves too fast, i.e. when the elevator might be falling. The speed detection mechanism in this sense acts as an overspeed detector.

A hoisting wire rope of the service elevator or a dedicated safety wire rope may pass through an entry hole in the safety device, through the interior of the safety device and exit the safety device through an exit hole at an opposite end. Some form of clamping mechanism for clamping the hoisting wire rope or the safety wire rope when an unsafe condition exists (i.e. when the overspeed detector trips) may be incorporated in the safety device.

Fall-arrest devices, when fitted to an appropriate wire rope, can be of the type that comprises internal rollers and a clamping mechanism (e.g. involving clamping jaws) which closes onto the safety wire rope, which could be the main hoisting wire rope or a separate safety wire rope. These devices may comprise a centrifugal overspeed detector.

Such an overspeed detector may comprise a driven roller coupled with movable parts that are forced outwardly as the roller rotates when it is driven by the wire rope passing along it. A pressure roller ensures the contact between the wire rope and the driven roller of the centrifugal overspeed detector. If the wire rope passes through the safety device too rapidly, the brake trips and the jaws clamp onto the wire, thus blocking the safety device on the wire rope.

The overspeed detector is provided on the inside of the casing of the fall arrest device. During use of such a fall arrest device, the driven roller may loose contact with the wire rope due to wear. If the contact with the wire rope is lost, then the driven roller does not rotate with a movement of the wire rope (or does not rotate sufficiently rapidly). As a result, an overspeed may not be reliably detected. It is thus important to check whether the overspeed detector is working properly. A little inspection window is generally provided on a sidewall of the casing which allows personnel to check whether the centrifugal overspeed detector is rotating. However, the inspection window does not always allow good visibility of the overspeed detector. Moreover, as the fall arrest device is mounted to the elevator, the inspection window is not always readily accessible for personnel.

Furthermore, even if the overspeed detector can be seen properly and appears to be working well, it is possible that in fact the roller of the detector is not rotating as quickly as it should. Wear to the driven roller (and or pressure roller) can lead to a situation wherein there is still contact between the wire rope and the driven roller, but this contact is not as it should be. As a result, the overspeed detector rotates but is also not capable of reliably indicating an overspeed situation.

The present disclosure provides examples of systems and methods that at least partially resolve some of the aforementioned disadvantages.

Service elevators and related safety devices such as fall arrest devices are not only used in wind turbine towers, but instead may be found in many different sites and structures.

The words "elevators" and "lifts" are used interchangeably throughout the present disclosure.

SUMMARY

According to a first aspect, a fall arrest device configured to be mounted around a wire rope of an elevator is provided. The fall arrest device comprises a casing with an entry hole for the wire rope, and an exit hole for the wire rope. It further comprises a clamping mechanism and an overspeed detector arranged inside the casing. The overspeed detector comprises a driven roller arranged to be driven by the wire rope and wherein the clamping mechanism is configured to clamp the wire rope if the overspeed detector detects a speed of the driven roller above a predetermined threshold. The driven roller has one or more selected areas to be detected by a sensor, and the device further comprises a motion indicator configured to receive a signal from the sensor when the sensor detects one of the selected areas. The motion indicator is configured to give different indications depending on whether or not the signal is received from the sensor, and such indications are detectable from outside the casing.

In this aspect, information regarding the proper functioning of the overspeed detector is readily provided to an operator or maintenance personnel without needing access to the fall arrest device. The driven roller has one or more selected areas to be detected by a sensor inside the casing. As the driven roller rotates, the selected areas are repeatedly sensed by the sensor. The motion indicator receives a signal when one of the selected areas is detected.

As the roller rotates, the motion indicator repeatedly receives such signals and indicates this movement on the outside of the casing. The motion indicator may e.g. be a light, such as a LED. Proper functioning of the overspeed detector would thus be visible by a flashing light. The motion detector may be mounted on the outside of the casing of the fall arrest device, but could alternatively be mounted in other suitable locations (e.g. on the outside of the elevator, or in a location at the bottom of a tower or building) in which the indications can easily be sensed by an operator.

In some examples, the sensor may be provided on the inside the casing and may be a photoelectric sensor. Selected areas may be provided with a reflective paint or a reflective sticker. The photoelectric sensor emits light and if a selected area passes in front of it, the light is reflected and received by the sensor. This is merely one way of implementing sensing of the rotation of the roller. An example of a photoelectric sensor that may be used inside the casing can be a color sensor or a contrast sensor. Such sensors may be configured to detect different surfaces based on the colour of the surface. An aspect of using a contrast or color sensor is that it does not rely on a type of material as an inductive sensor does. The color or contrast sensor can be lightweight and require little space. Color sensors may emit white light, detect the reflection and analyze three beams of reflected colored light (red, blue, green), and then measure the level of light reflected back on each wave length.

The level of reflected light may be compared to values stored in the sensor's memory. If the value is within its tolerance limits, recognition of that value triggers the output.

In other examples, an inductive sensor might be used. If the overspeed detector is a centrifugal overspeed detector, then the weights move outwardly with increasing speed. In such examples, photoelectric sensors may be more easily implemented.

In some examples, the wire rope upon which the fall arrest device may be the hoisting wire rope of the elevator. In other examples, a dedicated safety wire rope in addition to the hoisting or traction wire rope may be provided.

In a further aspect, an elevator system comprising an elevator and a fall arrest device according to any of the examples herein described is provided. In yet a further aspect, the present disclosure provides a wind turbine comprising such an elevator system.

In yet a further aspect, a method for operating an elevator system according to any of the examples disclosed herein is provided. The elevator is operated by a traction mechanism, and the method comprises deriving an estimated speed of the wire rope from the speed of the driven roller, deriving an actual speed of the wire rope from the traction mechanism, and comparing the estimated speed with the actual speed. A warning signal is issued if a difference between the actual speed and the estimated speed is higher than a predetermined threshold.

In this aspect, the additional information provided by sensing the driven roller in the fall arrest device is not only used for indicating the fact that the roller is rotating. Additionally, ongoing wear of the roller may be noted before it becomes a problem. Increasing wear can result in the roller rotating, but not as quickly as it should. If this is detected, a warning signal may be issued. The warning signal can be of any type. The emission of the warning signal might lead to maintenance being scheduled on short notice.

In yet a further aspect, the present disclosure provides a method for retrofitting a fall arrest device comprising a casing with an entry hole for a wire rope, and an exit hole for a wire rope, and a clamping mechanism and an overspeed detector arranged inside the casing. The overspeed detector comprises a driven roller arranged to be driven by the wire rope and the clamping mechanism is configured to clamp the wire rope if the overspeed detector detects a speed of the driven roller above a predetermined threshold. The method comprises providing a sensor configured to detect selected areas of the driven roller, and providing a motion indicator configured to receive a signal from the sensor when the sensor detects one of the selected areas, wherein the motion indicator is configured to give different indications depending on whether or not the signal is received from the sensor, and such indications being detectable from outside the casing.

In some examples, such a method may comprise making selected areas of the driven roller detectable by the sensor. This may comprise colouring portions of a driven roller, making parts reflective by sticking a foil or by painting.

According to this aspect, existing fall arrest devices may be retrofitted and provided with the additional functionality herein described.

Throughout the present description and claims, an elevator path is to be understood as a space or passage through which the elevator can travel upwards and downwards. In a wind turbine tower, the elevator path is thus defined inside the tower. There may be a closed space inside the tower along which the cabin travels. Alternatively, the space inside the tower may be open.

Throughout the present description and claims, an overspeed detector may be any suitable speed detection mechanism. Such speed detection mechanisms may preferably be configured to compare a detected speed with a predetermined threshold and when the detected speed is higher than the threshold, an alarm signal may be issued or an alarm mechanism may be activated.

BRIEF DESCRIPTION OF THE DRAWINGS

Non-limiting examples of the present disclosure will be described in the following, with reference to the appended drawings, in which.

DETAILED DESCRIPTION OF EXAMPLES

In these figures the same reference signs have been used to designate matching elements.

Figure 1:
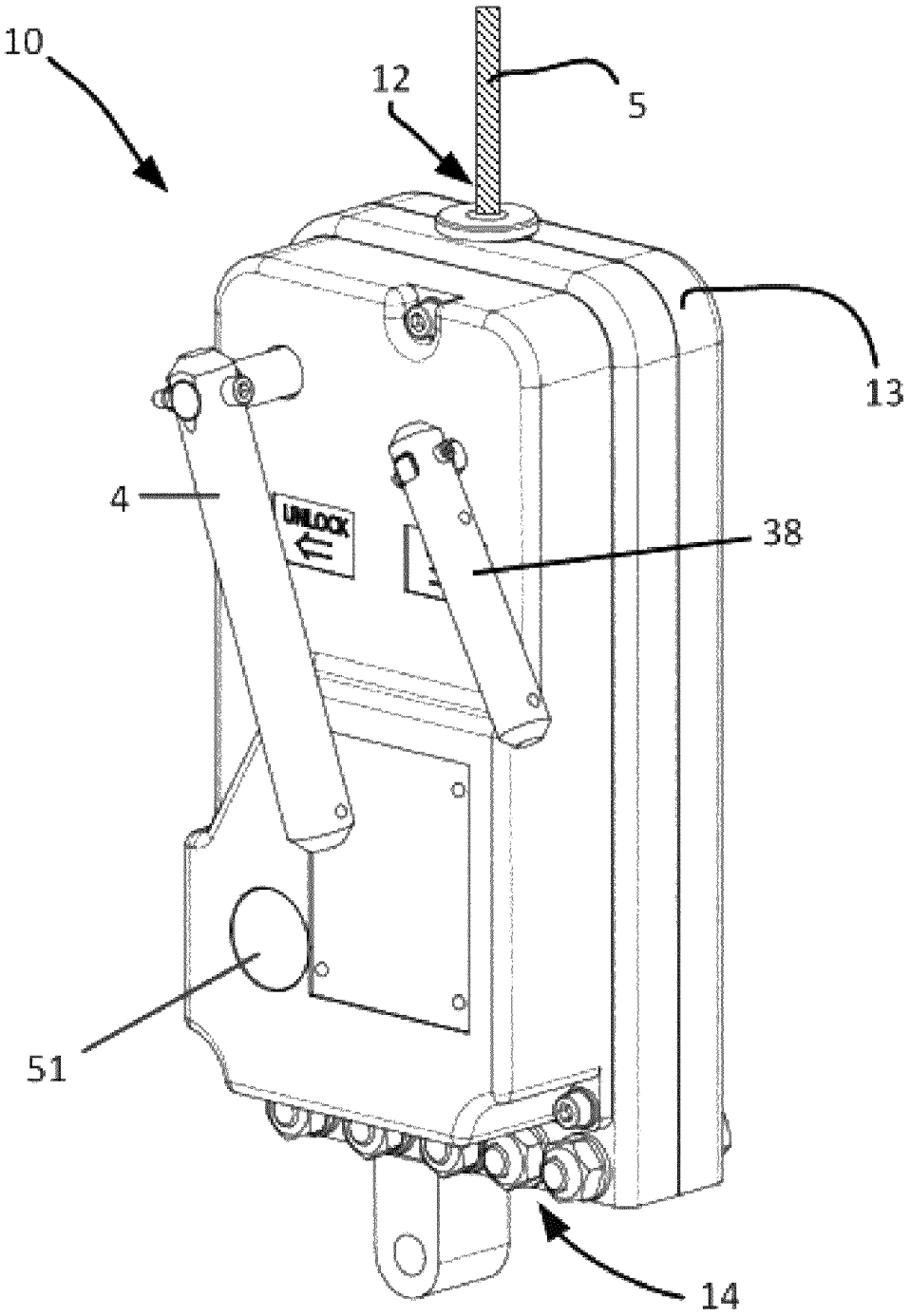
FIG. 1 is a perspective view of an example of a fall-arrest device.

FIG. 1 schematically illustrates a fall arrest device. The fall arrest device 10 of FIG. 1 is mounted on an elevator, and the fall arrest device comprises a housing 13 having an upper wire rope entry 12, an unlocking lever 4 and an inspection window 51. The housing further comprises a lower wire rope exit 14. Also indicated in FIG. 1 is an emergency locking lever 38. The wire rope 5 passes through the fall arrest device 10.

Figure 2A:
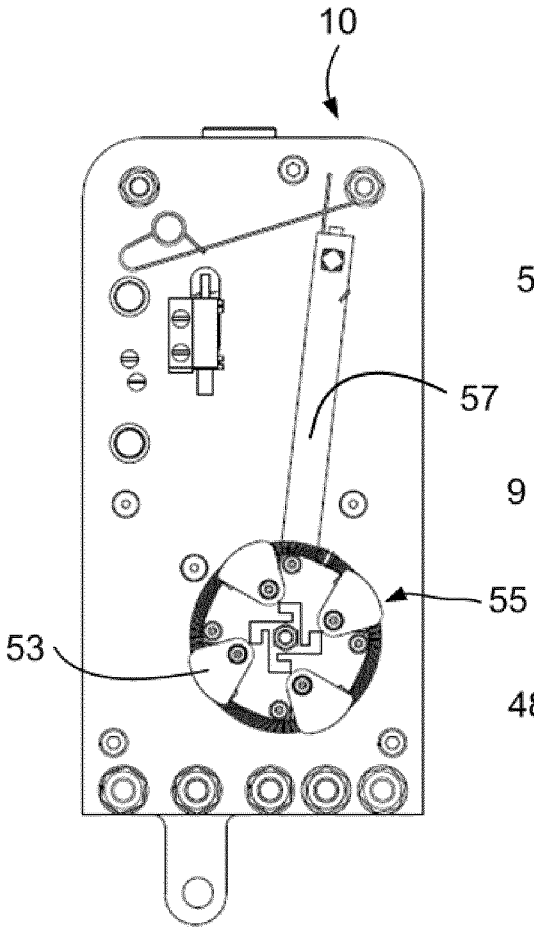
FIGS. 2*a*-2*c* show longitudinal cross-sectional views and a cross-sectional top view of a fall arrest device which may the same or similar to the fall-arrest device shown in FIG. 1.
Figure 2B:
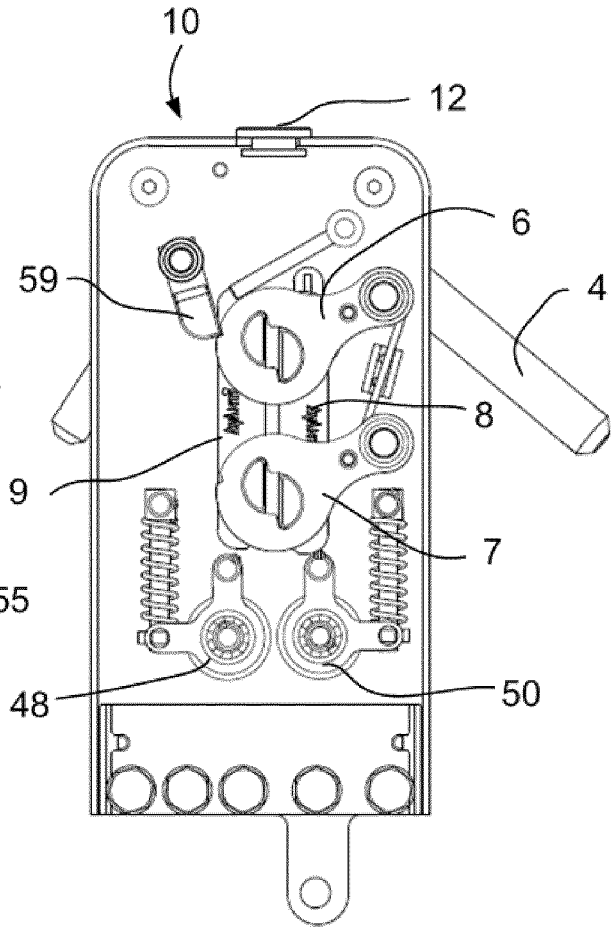
Figure 2C:
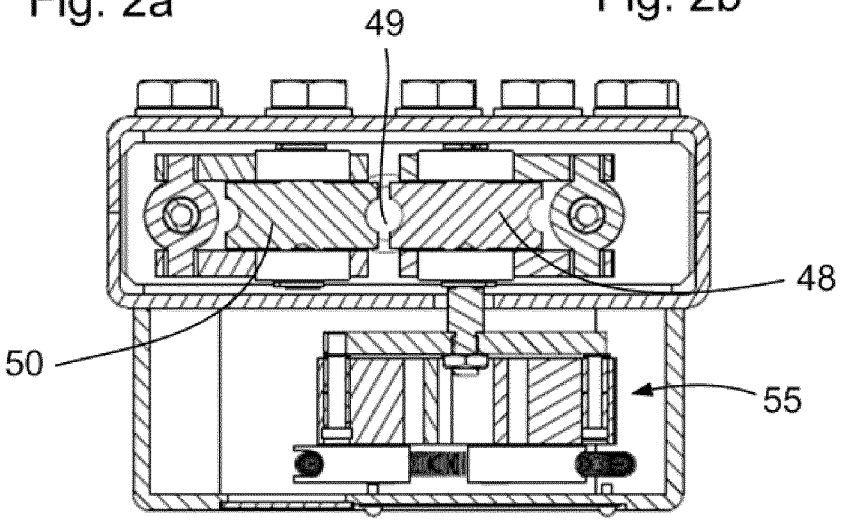

FIGS. 2*a*-2*c* schematically illustrate cross-sectional views of a safety device 10 similar to the one shown in FIG. 1. In the interior of the housing of the safety device 10, at least one safety mechanism is provided. The safety mechanism acts on the wire rope, and therefore may be subject to wear. In particular, the parts and components that are substantially constantly in contact with the wire rope may be subject to wear.

FIG. 2*b* illustrates an entry hole 12 for a wire rope. The wire rope passes in between the clamping jaws 8, 9 of upper clamp 6 and lower clamp 7. In normal operation, the clamping jaws are "open", and there is substantially no contact between the wire rope and the clamping jaws. The jaws are in normal operation prevented from closing by blocking element 59. If in operation, an overspeed of the wire rope is detected (this indicates that the elevator to which the safety device is mounted is falling), the overspeed detector trips which moves the blocking element 59 and allows the jaws 6, 7 to close. The elevator is thus prevented from falling.

The overspeed detection and trip mechanism may comprise a first driven roller 48 which is in contact with the wire rope. As the wire rope moves, the roller 48 is driven and rotates. The first driven roller 48 is operatively coupled with the driven roller of the centrifugal overspeed detector 55 shown in FIG. 2*a*. Both the driven roller 48 and the driven roller of the overspeed detector 55 may be mounted on the same axle of shaft.

The overspeed detector 55 may comprise a plurality of weights 53, which are configured to move outwards as the detector rotates due to the centrifugal forces acting on them. If the driven roller rotates too fast (i.e. this may indicate an unsafe condition caused by e.g. a traction hoist malfunction and/or electromagnetic brake malfunction), the weights 53 move outwardly to such an extent that the detector trips: the weights contact lever 57, which releases the blocking element 59 from its original position. When the detector trips, as explained before, the clamping jaws close down and the elevator comes to a halt.

In order to ensure that the first driven roller 48 is in fact driven by the movement of the wire rope, a pressure roller 50 may force both of them in contact with each other. Reference sign 49 indicates the space between the first driven roller 48 and the pressure roller 50 through which the wire rope passes. Both the pressure roller 50 and the driven roller 48 are constantly in contact with the tensioned wire rope. The contact between the wire rope and the rollers may result in wear of the grooves along the perimeters of the rollers. As a result of wear, the driven roller may not be driven at all by the wire rope, or may not rotate at the correct speed. Either one of these situations can be dangerous as they both compromise the correct functioning of the overspeed detector.

Figure 3A:
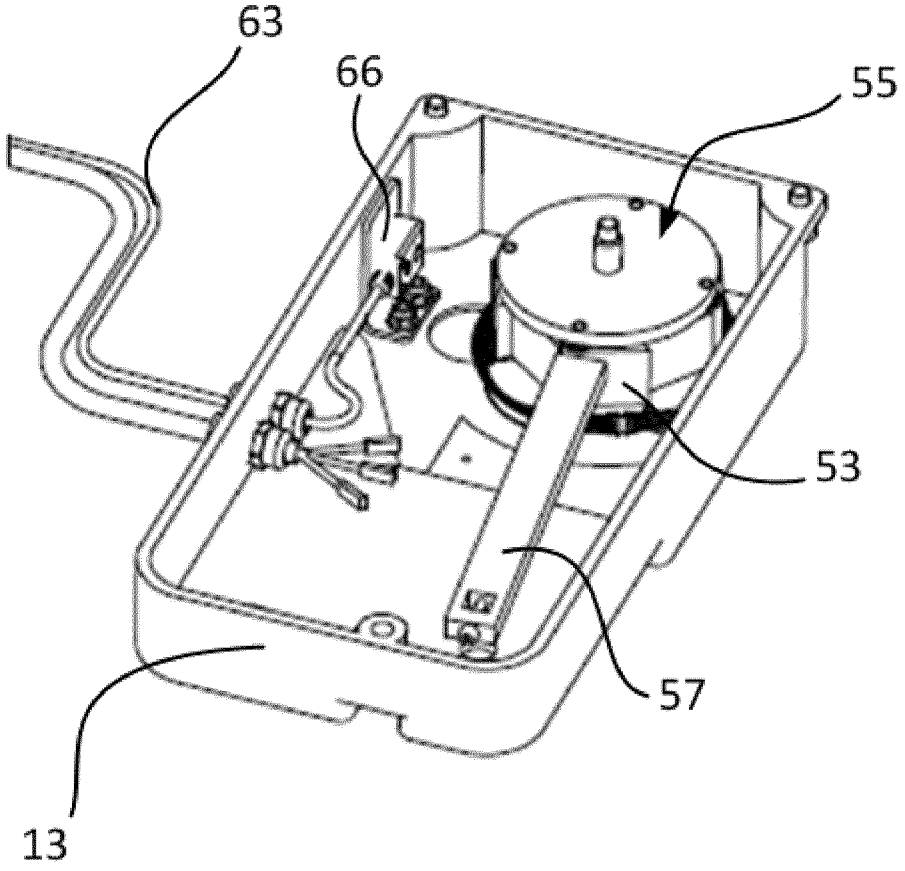
FIGS. 3*a*-3*c* schematically illustrate an example of a fall arrest device including an additional sensing mechanism and a motion indicator.
Figure 3B:
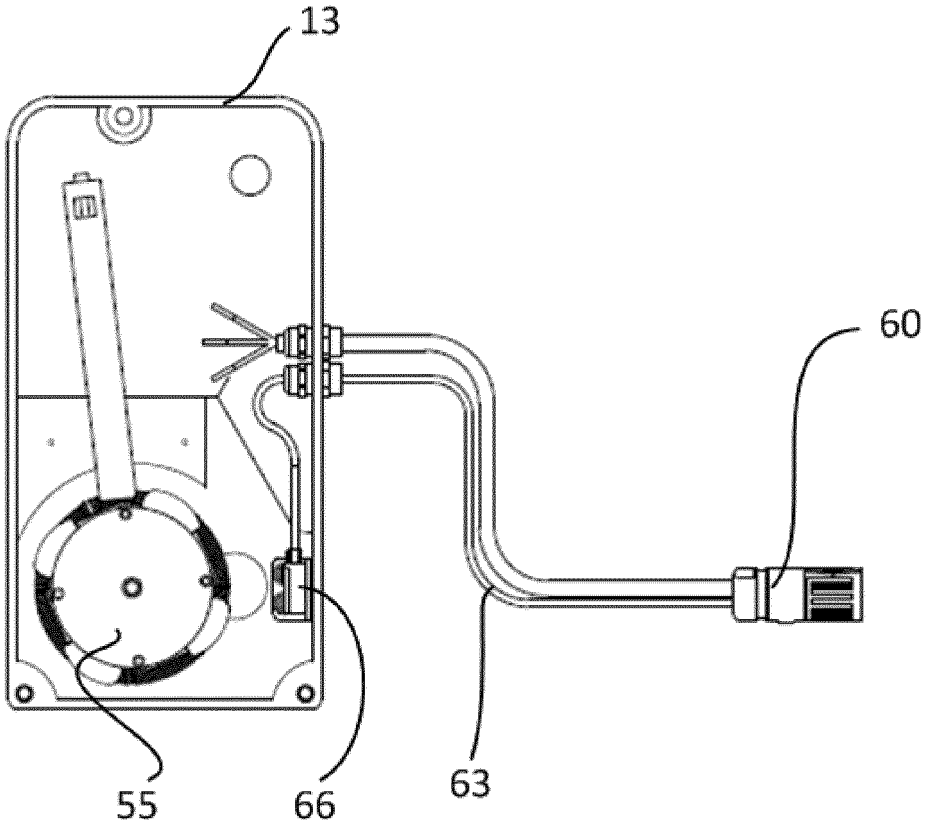
Figure 3C:
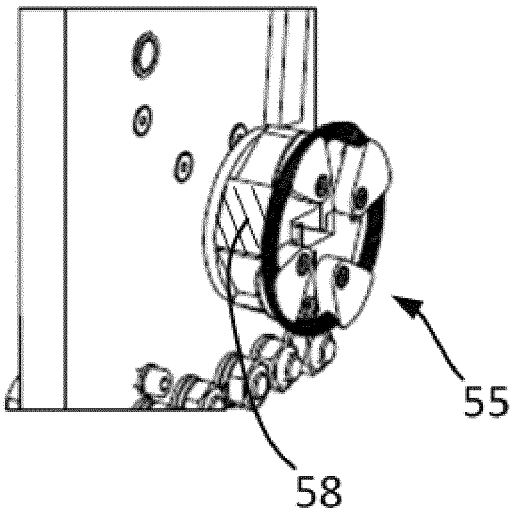

FIGS. 3*a*-3*c* show schematic views inside the casing of a fall arrest device such as the one described with reference to FIG. 1 and FIGS. 2*a*-2*c*. Even though in the following reference will be made to such a fall arrest device, it should be clear that a similar teaching may be applied to different kinds of fall arrest devices: e.g. the clamping mechanism may be different from the one described before, and the overspeed detector may be different. The overspeed detector might be a centrifugal overspeed detector, but does not necessarily need to be of this type.

The wire rope, either directly or indirectly, drives the driven roller of the centrifugal overspeed detector. In this example, a photocell detector 66 is used. The photocell detector 66 according to this example has a light transmitter, and a light receiver. The photocell detector is connected to a connector 60 through an electric, data or fiber cable 63.

Connector 60 may be connected to an indicator, such as e.g. a light, in particular a LED. This light may be mounted on the outside of casing 13 of the safety device but may also be installed in a suitable location on the elevator. In a further example, it may also be located remotely in a position in which it is visible to operating personnel. In one example, the indicator may be mounted to an inside wall of a wind turbine tower.

Selected parts 58 of e.g. the perimeter of the driven roller of the centrifugal overspeed detector 55 or of the centrifugal elements 53 may be made to be reflective using a foil or paint, or other. Alternatively, selected parts of the driven roller of the centrifugal overspeed detector may be made to be non-reflective.

As a result, selected parts 58 of the driven roller of the centrifugal overspeed detector will reflect light received from the transmitter to the receiver, whereas other parts of the driven roller will not reflect the light. As the driven roller rotates, it continuously receives alternating signals of light, and no light, or "reflective" and "non-reflective". The detector 66 thus selectively turns the indicator on and off repeatedly. Such a transmission of the alternating signals may be through an electric, data or fiber cable 63 or may be wireless.

The indicator may give a visual indication (a light), an audible indication, or a combination of these each time a "light" signal is received (or alternatively, each time, a "no-light" signal is received). As a result, the motion indicator will give continuously alternating indications when the driven roller is rotating. This may easily be noted by personnel, even if no direct access to the fall arrest device is available. A flashing light may easily be detected from a distance and even in circumstances of relative darkness.

In this particular example, selected parts of a driven roller of the centrifugal speed detector were detected. This driven roller is not in direct contact with the wire rope, but instead is indirectly driven as it is operatively coupled with the first driven roller 48. In other examples, selected parts or areas of the first driven roller may be detected in a similar manner as described before.

Furthermore, in this particular example, reference was made to a photocell detector based on the presence or absence of reflection, but alternative sensors might be used. In another example, sensors suitable for determining the colour of a surface may be used. The centrifugal elements may then be distinguished from other parts of the driven roller based on their colour.

One other example of a sensor that may be used is an inductive sensor. Selected portions or areas of the driven roller or centrifugal elements may be made from a different material. The inductive sensor may thus again receive alternating signals, "material A", "material B", or simply "positive" and "negative". Each of these examples of sensors take up little space in a fall arrest device and make retrofitting existing fall arrest devices with the additional described capability possible. Depending on the type of sensor used, existing fall arrest devices may be simply retrofitted by installing the sensor and connecting the indicator with the sensor.

In other cases, specific portions or areas of the driven roller are made detectable, and/or others non-detectable. A suitable sensor inside the casing and a motion indicator giving indications that are visible or hearable from the outside of the casing may be easily incorporated.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A fall arrest device configured to be mounted around a wire rope of an elevator, the fall arrest device comprising a casing with an entry hole for the wire rope, and an exit hole for the wire rope, and a clamping mechanism and an overspeed detector arranged inside the casing, the overspeed detector comprising a driven roller arranged to be driven by the wire rope and wherein the clamping mechanism is configured to clamp the wire rope if the overspeed detector detects a speed of the driven roller above a predetermined threshold, wherein the driven roller has one or more selected areas to be detected by a sensor, and the device further comprising a motion indicator configured to receive a signal from the sensor when the sensor detects one of the selected areas, and the motion indicator is configured to give different indications depending on whether or not the signal is received from the sensor, such indications being detectable from outside the casing.

2. The fall arrest device according to claim 1, wherein the sensor inside the casing is a photoelectric sensor.

3. The fall arrest device according to claim 1, wherein the sensor inside the casing is an inductive sensor.

4. The fall arrest device according to claim 1, wherein the sensor is a color sensor or a contrast sensor.

5. The fall arrest device according to claim 4, wherein the overspeed detector further comprises a pressure roller configured to force the wire rope and the driven roller into contact.

6. The fall arrest device according to claim 1, wherein the overspeed detector further comprises a pressure roller configured to force the wire rope and the driven roller into contact.

7. The fall arrest device according to claim 6, wherein the overspeed detector is a centrifugal speed detection mechanism.

8. The fall arrest device according to claim 1, wherein the overspeed detector is a centrifugal speed detection mechanism.

9. The fall arrest device according to claim 8, wherein the motion indicator is a light.

10. The fall arrest device according to claim 1, wherein the motion indicator is a light.

11. The fall arrest device according to claim 10, wherein the wire rope is a hoisting wire rope of the elevator.

12. The fall arrest device according to claim 1, wherein the wire rope is a hoisting wire rope of the elevator.

13. The fall arrest device according to claim 12, wherein the casing further comprises an inspection window for viewing the speed detection mechanism.

14. The fall arrest device according to claim 1, wherein the casing further comprises an inspection window for viewing the speed detection mechanism.

15. An elevator system comprising the fall arrest device according to claim 1, and the elevator.

16. A wind turbine comprising the elevator system according to claim 15.

17. A method for operating the elevator according to claim 15, wherein the elevator is operated by a traction mechanism, and the method comprising deriving an estimated speed of the wire rope from the speed of the driven roller, deriving an actual speed of the wire rope from the traction mechanism, and comparing the estimated speed with the actual speed, and issuing a warning signal if a difference between the actual speed and the estimated speed is higher than a predetermined threshold.

18. The method for retrofitting a fall arrest device comprising a casing with an entry hole for a wire rope, and an exit hole for a wire rope, and a clamping mechanism and an overspeed detector arranged inside the casing, the overspeed detector comprising a driven roller arranged to be driven by the wire rope and wherein the clamping mechanism is configured to clamp the wire rope if the overspeed detector detects a speed of the driven roller above a predetermined threshold, the method comprising:

providing a sensor configured to detect selected areas of the driven roller, and providing a motion indicator configured to receive a signal from the sensor when the sensor detects one of the selected areas, wherein the motion indicator is configured to give different indications depending on whether or not the signal is received from the sensor, and such indications being detectable from outside the casing.

19. The method according to claim 18, further comprising making selected areas of the driven roller detectable by the sensor.

20. A method according to claim 19, wherein making one or more selected areas of the driven roller detectable by the sensor includes providing one or more of a reflective foil, reflective paint, reflective coating or reflective sticker on the selected areas.

* * * * *